US007328801B2

(12) United States Patent
Iossi

(10) Patent No.: US 7,328,801 B2
(45) Date of Patent: Feb. 12, 2008

(54) STORAGE AND DISPENSING UNIT

(75) Inventor: Cheryl L. Iossi, Toledo, OH (US)

(73) Assignee: Omnicare, Inc., Covington, KY (US)

( * ) Notice: Subject to any disclaimer, the term of this patent is extended or adjusted under 35 U.S.C. 154(b) by 640 days.

(21) Appl. No.: 10/803,664

(22) Filed: Mar. 18, 2004

(65) Prior Publication Data

US 2005/0205457 A1 Sep. 22, 2005

(51) Int. Cl.
*B65D 83/04* (2006.01)

(52) U.S. Cl. ..... 206/531; 206/528; 206/538

(58) Field of Classification Search ..... 206/528, 206/531, 532, 534.1, 538, 539, 469
See application file for complete search history.

(56) References Cited

U.S. PATENT DOCUMENTS 3,941,248 A * 3/1976 Moser et al. ..... 206/531
5,088,603 A * 2/1992 Kirkpatrick ..... 206/530
5,551,567 A 9/1996 Malone et al.
5,791,478 A 8/1998 Kalvelage et al.
5,904,249 A 5/1999 Roulin et al.
5,927,500 A 7/1999 Godfrey et al.
6,006,913 A 12/1999 Lüdemann et al.
6,024,222 A 2/2000 Friberg et al.
6,036,016 A 3/2000 Arnold
6,155,423 A 12/2000 Katzner et al.
6,161,699 A 12/2000 Gartland
6,253,920 B1 * 7/2001 Kallgren ..... 206/532
6,401,926 B1 6/2002 Lo
6,422,391 B1 7/2002 Swartz
6,516,949 B2 2/2003 Fuller et al.
6,540,081 B2 4/2003 Balz et al.
6,598,745 B2 7/2003 Bolnick et al.
2002/0162768 A1 * 11/2002 Bolnick et al. ..... 206/532
2002/0166790 A1 * 11/2002 Aylward ..... 206/531

* cited by examiner

*Primary Examiner*—David T. Fidei
(74) *Attorney, Agent, or Firm*—Ostrolenk, Faber, Gerb & Soffen, LLP

(57) ABSTRACT

A storage unit including a storage sheet having a plurality of compartments for storing a component therein, each compartment having a length and a first tear guide line located on the storage sheet. The storage unit further includes a second tear guide line located on the storage sheet. The first and second tear guide lines each have a length greater than a length of each compartment, and the first tear guide line is more easily torn than the second tear guide line.

20 Claims, 6 Drawing Sheets

STORAGE AND DISPENSING UNIT

The present invention is directed to a storage and dispensing unit, and more particularly, to a storage and dispensing unit having tear guide lines to aid a user in tearing the storage and dispensing unit for reuse.

BACKGROUND

Medication is often packaged in dispensing sheet form. In particular, a dispensing sheet may include a plurality of compartments or blisters formed therein, with each compartment or blister storing a medication unit therein. In order to dispense a medication unit for use or consumption, a user may press on the front side of the sheet, thereby forcing the medication unit through the rear of the sheet.

Institutional medical facilities, such as nursing homes, typically utilize such dispensing sheets in a form commonly known as "bingo cards." Such bingo cards may include a relatively large number of medication units stored therein. For example, a typical bingo card includes thirty, thirty-one or various other numbers of medication units to supply at least a month's worth of medication units to a particular user.

Institutional medical facilities are under increasing pressures to increase the efficiency of their medication dispensing practices. For example, Chapter 1146 of United States Pharmacia guidelines, which are widely adopted in part or in whole by state legislatures, now allows for "reprocessing" of bingo cards by removing a bingo card from its cardboard carrier (while the medication units are still maintained in their original blisters) and placing the bingo card into another cardboard carrier. In particular, when a user of a particular bingo card ceases use of a medication in a particular bingo card (i.e. due to a change in condition, change in prescription, expiration of the user, or other causes) the institutional medical facility may desire to dispense the remaining, unused medication units in the bingo card to another user.

However, existing bingo cards may be difficult to tear to separate the compartments containing medication from the empty storage compartments. Furthermore, even if bingo cards include perforations or the like to allow the filled and emptied storage compartments to be separated from each other, such perforation lines may be prone to tearing when dispensing individual ones of the medication unit (i.e. pushing a medication unit through the rear of the dispensing sheet). Accordingly, there is a need for a storage and dispensing unit having a tear guide line which can be easily accessed, and a storage and dispensing unit which will allow storage compartments to be separated yet which is robust enough to withstand dispensing of individual components.

SUMMARY

Accordingly, in one embodiment the invention is a storage and dispensing unit having a tear guide line which can be easily accessed. In another embodiment, the present invention is a medication and dispensing unit which allows storage compartments to be separated yet which is robust enough to withstand dispensing of individual components without tearing.

In particular, in one embodiment the present invention is a storage unit including a storage sheet having a plurality of compartments for storing a component therein, each compartment having a length and a first tear guide line located on the storage sheet. The storage unit further includes a second tear guide line located on the storage sheet. The first and second tear guide lines each have a length greater than a length of each compartment, and the first tear guide line is more easily torn than the second tear guide line.

In another embodiment the invention is a storage unit including a storage sheet having a plurality of compartments for storing a component therein, the storage sheet having an outer perimeter and an access edge formed therein that is at least partially spaced apart from the outer perimeter. The storage unit further includes a tear guide line located on the storage sheet and the tear guide line intersects the access edge such that the access edge provides access for tearing the tear guide line.

Other objects and advantages of the present invention will be apparent from the following description and the accompanying drawings.

DETAILED DESCRIPTION

Figure 1:
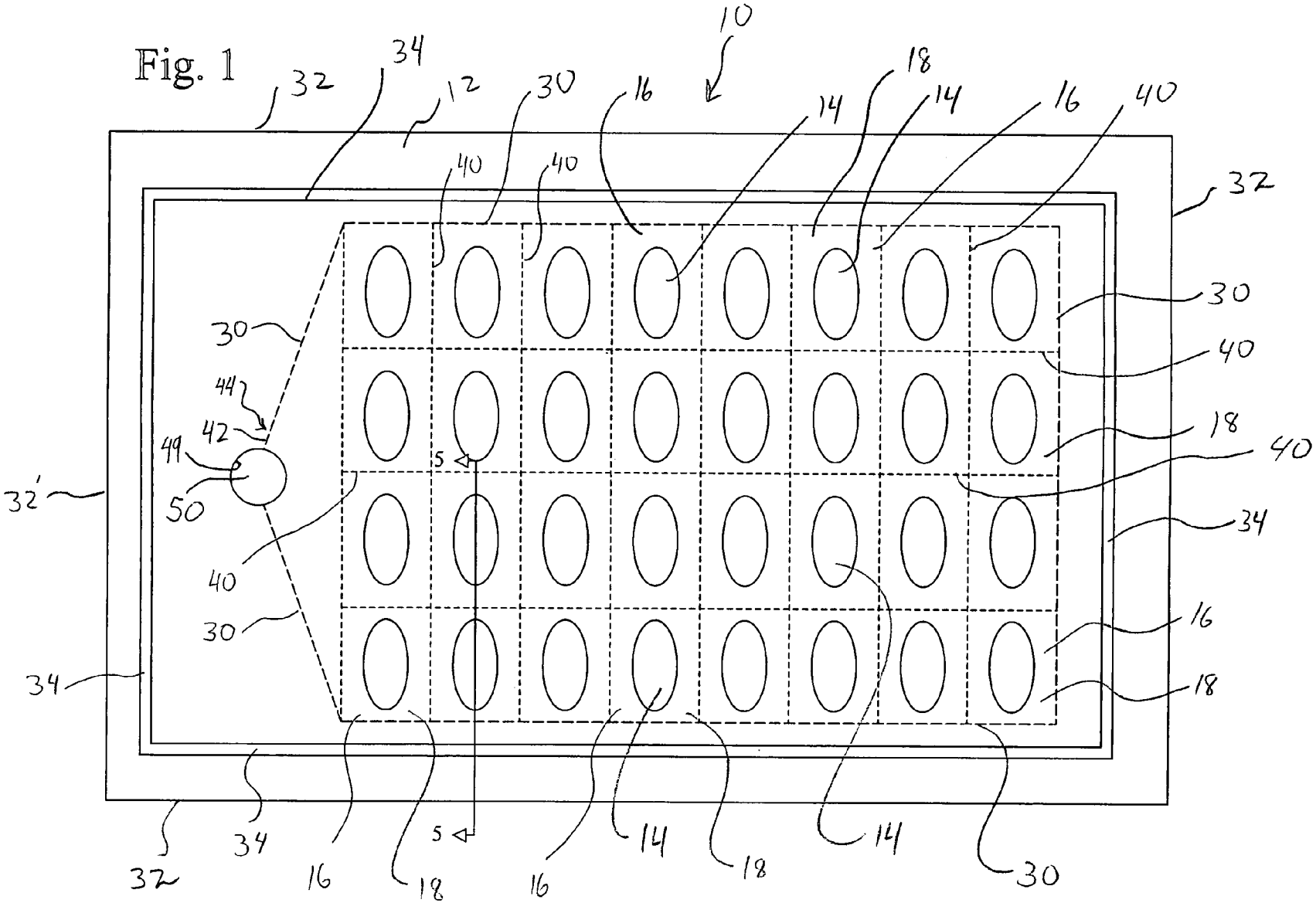
FIG. 1 is a top view of one embodiment of the storage and dispensing unit of the present invention.

As shown in FIGS. 1-6, the storage and dispensing unit of the present invention, generally designated 10, includes a storage sheet 12 which stores a plurality of components or medication units 14 therein. Each storage compartment 16 may be a rectangular prism with six generally flat sides (i.e. a cube, three-dimensional rectangle, etc.). Each compartment 16 may be generally oval-shaped in top view rather than rectangular, but may also have any of a wide variety of other shapes. The medication units 14 may take a variety of forms, including but not limited to pills, capsules, tablets and the like. The storage sheet 10 includes a plurality of compartments 16 with each compartment 16 having an inner cavity 18 generally closely receiving a medication unit 14 therein (see FIG. 4). It should be understood that the term "medication unit" may include a single pill, capsule, tablet or the like, as well as more than one pill, capsule, tablet or the like which are stored within a single compartment 16.

Figure 5:
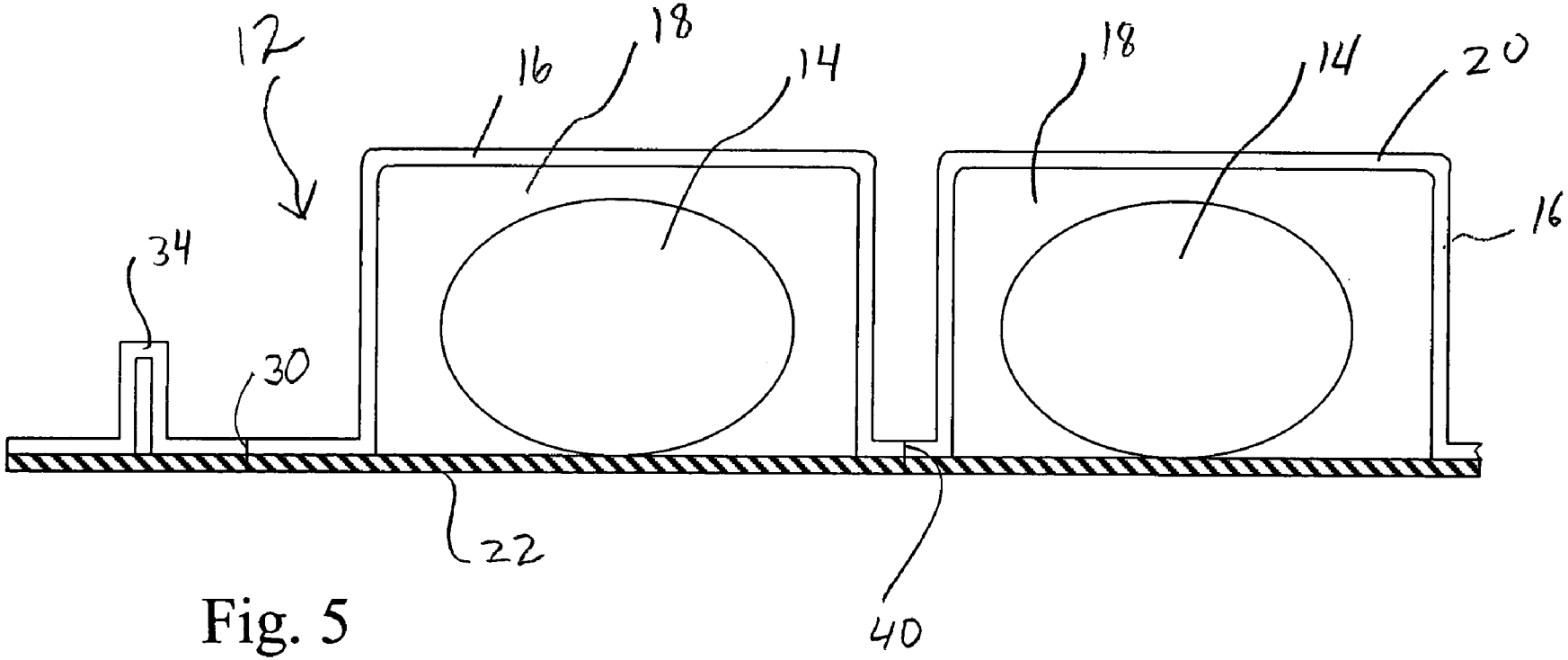
FIG. 5 is a side cross section taken along line 5-5 of the storage and dispensing unit of FIG. 1.

As shown in FIG. 5, the storage sheet 12 may include various layers. In the illustrated embodiment, the storage sheet 12 is generally flat and includes a blister containment sheet 20 and a lidding stock or rupture sheet 22. The containment sheet 20 is made of a relatively stiff or rigid material, and is preferably transparent. For example, the containment sheet 20 may be made of or include polyvinylchloride ("PVC"), polycholorotrifluoroehylene ("PCTFE") such as ACLAR® film sold by Allied Signal, a combination of PVC and a fluorene-containing plastic, a combination of PVC and polyvinylidene chloride ("PVDC") (utilizing PVDC material having weight of between about 20 grams and about 100 grams/$m^2$), polypropylene, nylon, polyethylene ("PE") or any of a wide variety of other materials. The containment sheet 20 may have a thickness of between about 1 mil to about 100 mils, or more particularly between about 5 mils and about 15 mils.

The containment sheet 20 may be made of material sufficiently strong and have sufficient thickness so as to generally resist manual tearing, but is sufficiently flexible so that a user can press and deform the containment sheet 20 to dispense a medication unit 14. For example, U.S. Pat. Nos. 6,024,222 and 6,006,913, the contents of which are hereby incorporated by reference, both disclose various storage sheets and materials for forming such storage sheets.

The rupture sheet 22 may be made of, for example, a metal (i.e., aluminum) foil, paper, a paper/foil combination, or a variety of other materials. The rupture sheet 22 may have a thickness of, for example, between about 0.1 mil to about 100 mils, or more particularly between about 0.5 mil to about 1 mil. Whatever material is chosen for the rupture sheet 22 should have a thickness that provides sufficient strength to maintain the medication units 14 in the compartments 16, while still being able to be ruptured when a user manually presses the medication unit 14 against the rupture sheet 22 with sufficient pressure.

The containment sheet 20 may include the plurality of storage compartments 16 (i.e., the sides and top of the storage compartments 16 or five sides of a rectangular prism). The rupture sheet 22 may be laid on top of the open end of the storage compartment 16 (i.e., forming the sixth side of the rectangular prism) to thereby seal the medication units 14 in the associated storage compartment 16. If desired, the storage sheet 12 may include a blocking sheet (not shown) located over and covering the rupture sheet 22 which can block the medication units 14 from being pressed through the rupture sheet 22 so that the blocking sheet must be removed (i.e., by peeling back the blocking sheet) when it is desired to dispense a medication unit 14 through the rupture sheet 22. The blocking sheet can be made of or include a wide variety of materials, such as paper, plastic, metal, etc.

Figure 2:
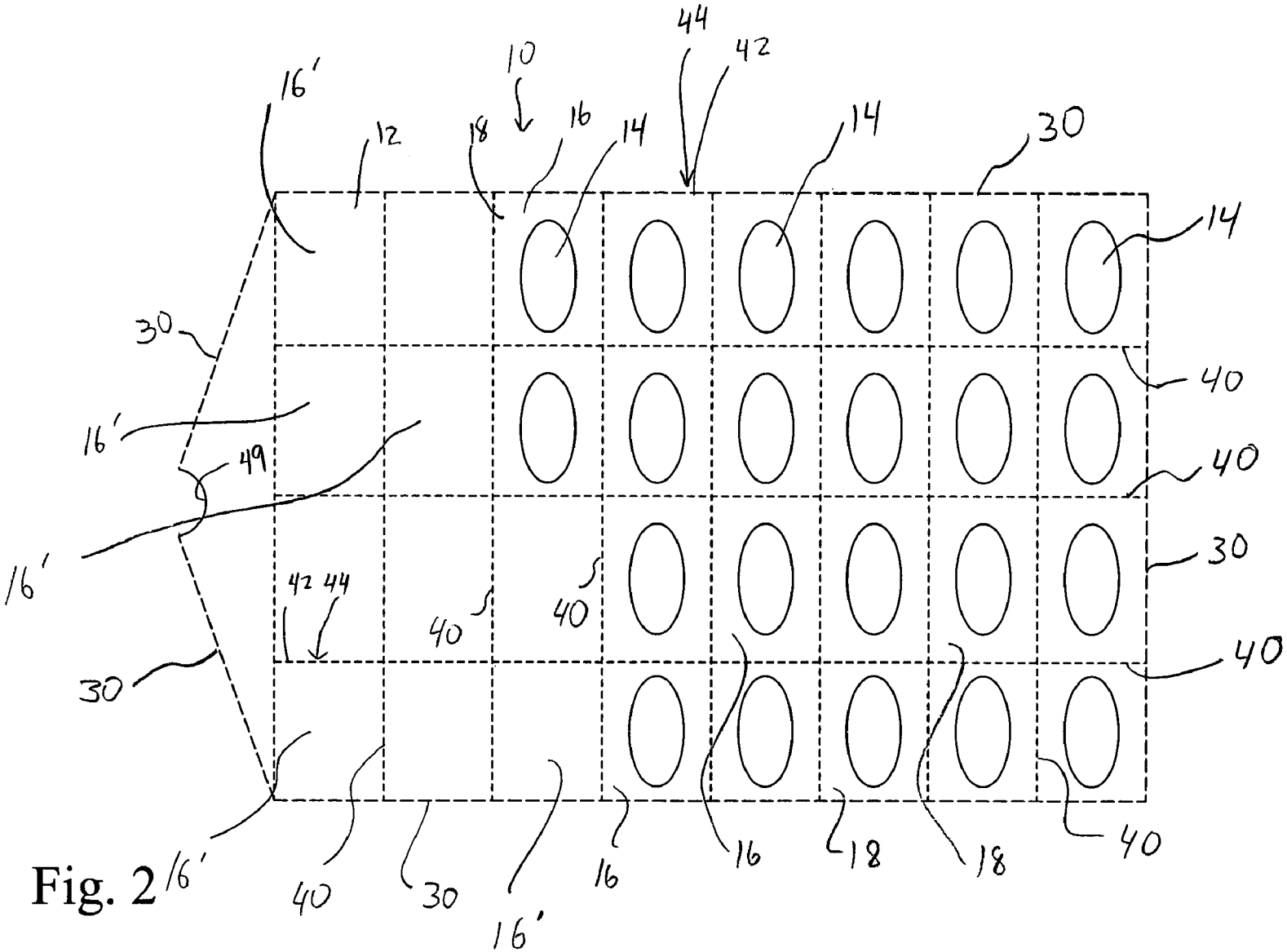
FIG. 2 is a top view of the storage and dispensing unit of FIG. 1, with certain ones of the medication units dispensed and the outer portion of the storage and dispensing unit being torn away.

As can be seen in FIGS. 1 and 2, the storage sheet 12 includes a perimeter tear guide line 30 located on the storage sheet 12 and forming a generally closed shape, with the plurality of compartments 16 and medication units 14 being located inside the generally closed shape of the perimeter tear guide line 30. The storage sheet 12 includes an outer perimeter 32, and the perimeter tear guide line 30 is located between the outer perimeter 32 and the plurality of medication units 14.

The storage sheet 12 also includes a reinforcing ridge 34 extending generally around the outer perimeter of the storage sheet 12. As can also be seen in FIG. 5, the reinforcing ridge 34 may be formed as a ridge in the containment sheet 20 to provide stiffness and structure to the storage sheet 12 to improve handling of the storage sheet 12. The reinforcing ridge 34 may be sufficiently stiff or strong to prevent a user from tearing the storage sheet 12 transversely across the reinforcing ridge 34. The storage sheet 12 may lack any tear guide lines that intersect the outer perimeter 32 or that cross the reinforcing ridge 34, as such tear guide lines may compromise the integrity of the storage sheet 12.

The storage sheet 12 further includes a plurality of interior tear guide lines 40 extending between the medication units 14/compartments 16. In the illustrated embodiment, the interior tear guide lines 40 extend between each adjacent medication unit 14/compartment 16 and between the opposite ends of the perimeter tear guide line 30 such that each medication unit 14/compartment 16 can be separated from the storage sheet 12 and/or from the other medication units 14/compartments 16 of the storage sheet 12. Each storage compartment 16 may have a length extending in a direction parallel to the storage sheet 12. Each tear guide line 30, 40 may extend or have a length greater than a length of the storage compartments 16.

The perimeter tear guide line 30 as well as the interior tear guide lines 40 may be perforation lines each of which include a plurality of slits 42 formed through the storage sheet 12, thereby defining a plurality of tabs 44 located between the slits 42. However, the tear guide lines 30, 40 may be lines other than perforation lines, and may include any type of guide line which guides the tearing of the storage sheet 12. For example, the tear guide lines 30, 40 may each be or include fold lines, crease lines, areas of weakness, score lines, cuts partially through the thickness of the storage sheet 12, draw-strings which can be pulled to create an area of weakness or separate portions of the storage sheet, etc. When the tear guide lines 30, 40 are score lines that are partially cut through the storage sheet 12, either or both of the containment sheet 20, rupture sheet 22 may be fully or partially cut through their thicknesses.

The perimeter tear guide line 30 may be configured such that it is more easily torn than the interior tear guide lines 40. For example, in one embodiment the perimetric tear guide line 30 is a perforation line having slits with a length of about 90 thousandth of an inch, and tabs or "land" areas having a length of about 20 thousandths of an inch. This in this embodiment the ratio of slit-to-land of the perimeter tear guide line 30 may be about 4.5 to 1. However the length of the slits and land of the perimeter tear guide line 30 may be varied to match the desired tearing or "tear ability" characteristics. The ratio of slit-to-land of the perimeter tear guide line 30 may be, for example, between about 20 to 1 and about 0.5 to 1. The slits may have a length of, for example, about 20 thousand of an inch to up to 1 inch or more. The land area may have a length of about 5 thousands of an inch up to about ¼ inch. In general, the land area cannot be made too long (without introducing some other tear guide line, such as a score line or the like) because when the land areas are too long any attempted tearing may not properly tear across the long land area.

Each of the interior tear guide lines 40 may be perforation lines having a slit or cut length of about 60 thousandths of an inch and a land length of about between about 28 and about 30 thousandth of an inch. In this embodiment the ratio of slit-to-land of the interior tear guide line 40 is about 2 to 1, although this ratio may be modified as desired. Of course any of a wide variety of lengths and cut-to-land configurations for the interior tear guide lines 40 may be used, including the lengths and ratios outlined above for the perimeter tear guide line 30. However, when the perimeter tear guide line 30 and interior tear guide lines 40 are perforation lines, the ratio of cut-to-land of the perimeter tear guide line 30 may be greater than the ratio of cut-to-land of the interior tear guide lines 40. Thus, cut-to-land ratio of the perimeter tear guide line 30 may be at least about twice that, or at least about 1½ times that of the cut-to-land ratio of the interior tear guide line 40.

The storage sheet 12 may include an access edge 49 defining an access opening 50 (FIG. 1) formed therethrough, and at least one of the perimeter tear guide lines 30 or interior tear guide lines 40 may intersect the access opening 50. The access opening 50 may be located generally above the medication units 14 (i.e. Adjacent to a top edge 32' of the storage sheet 12) and may be generally centered (or horizontally centered with respect to the center of gravity of the storage sheet 12) such that the access opening 50 may act as a hanger opening to receive a hanger therethrough. The access opening 50 is entirely spaced away from the outer perimeter 32 of the storage sheet 12. The access opening 50 may provide a "start" location for tearing the tear guide lines 30, 40. Thus, the access opening 50 may be large enough so the user can insert the tip of a finger into the access opening 50 to tear the associated tear guide line 30, or may be larger than a slit of the perforation lines. Each tear guide line 30, 40 may intersect the access opening 50, or the access opening 50 may be considered to be part of the tear guide lines 30, 40.

Figure 6:
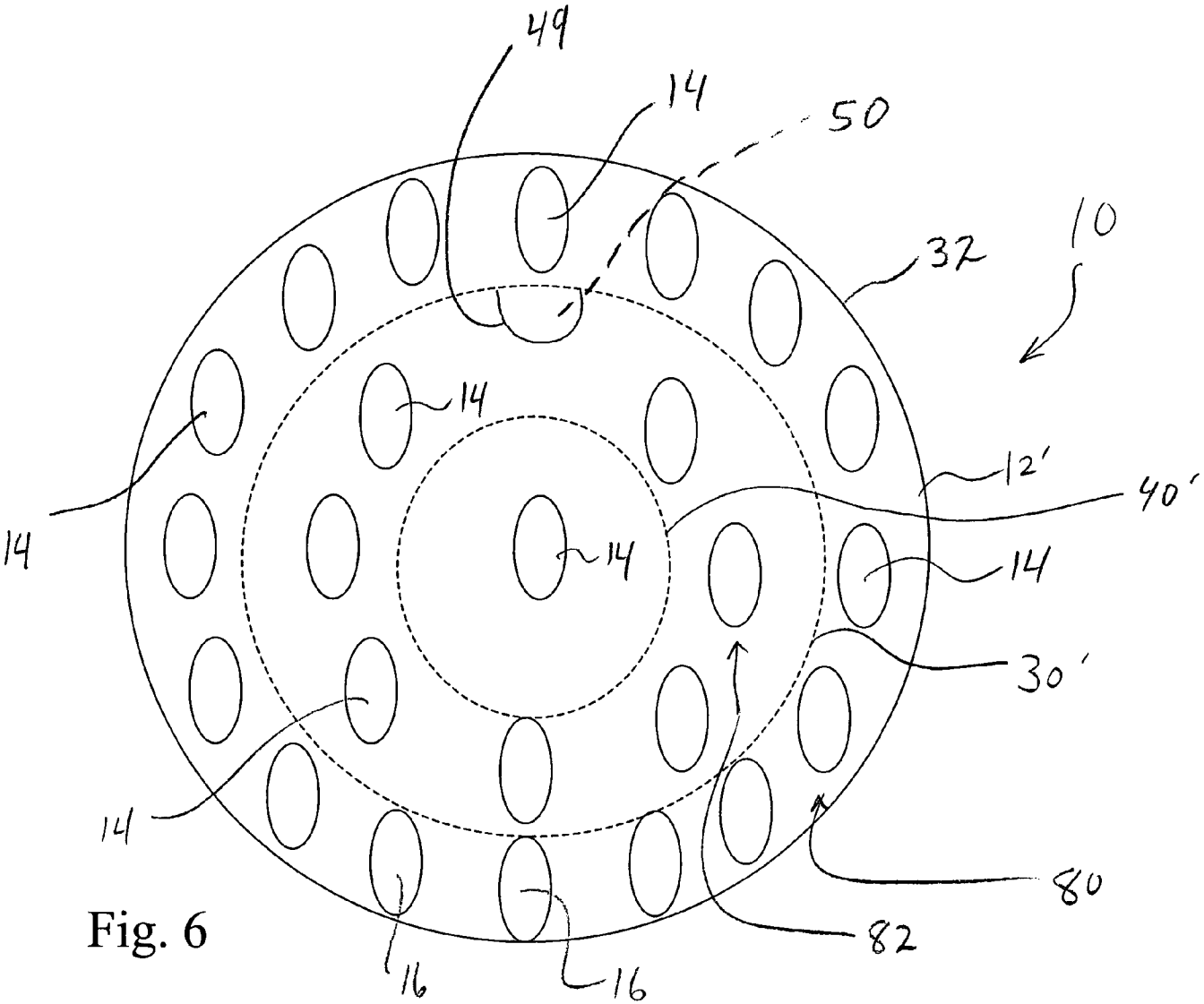
FIG. 6 is a top view of another embodiment of the storage and dispensing unit of the present invention.

In the illustrated embodiment the access edge 49 is circular to define a circular access opening 50. However, the access edge 49 may be any of a wide variety of shapes, and need not necessarily be a closed shape. For example, as shown in FIG. 6, the access edge 49 may be a cut line cut through the thickness of the storage sheet 12 defining a semicircle. In this case the partial cut-out defined by the access edge 49 may be pushed through the storage sheet 12 to gain access to the associated tear guide line 30', 40'.

FIG. 1 illustrates the medication storage and dispensing unit 10 filled with medication units 14. Once some of the medication units 14 have been dispensed resulting in empty compartments 16, it may be desired to separate the undispelled (or filled) compartments 16 from the empty compartments 16. In order to separate the filled compartments from the unfilled compartments, a user inserts a finger or other instrument into the access opening 50 and pulls downwardly (i.e. To the right in FIG. 1 towards the medication units 14), thereby tearing the storage sheet 12 about the perimeter tear guide line 30. The medication storage and dispensing unit may be folded along the perimeter tear guide line 30 prior to tearing. The entire perimeter tear guide line 30 is then torn and the outer rim of the sheet 12 is disposed of, resulting in the sheet 12 as shown in FIG. 2. Because the perimeter tear guide line 30 is more easily torn than the interior tear guide lines 40, the storage sheet 12 can be torn entirely around the perimeter tear guide line 30 without tearing any of the interior tear guide lines 40.

Figure 3:
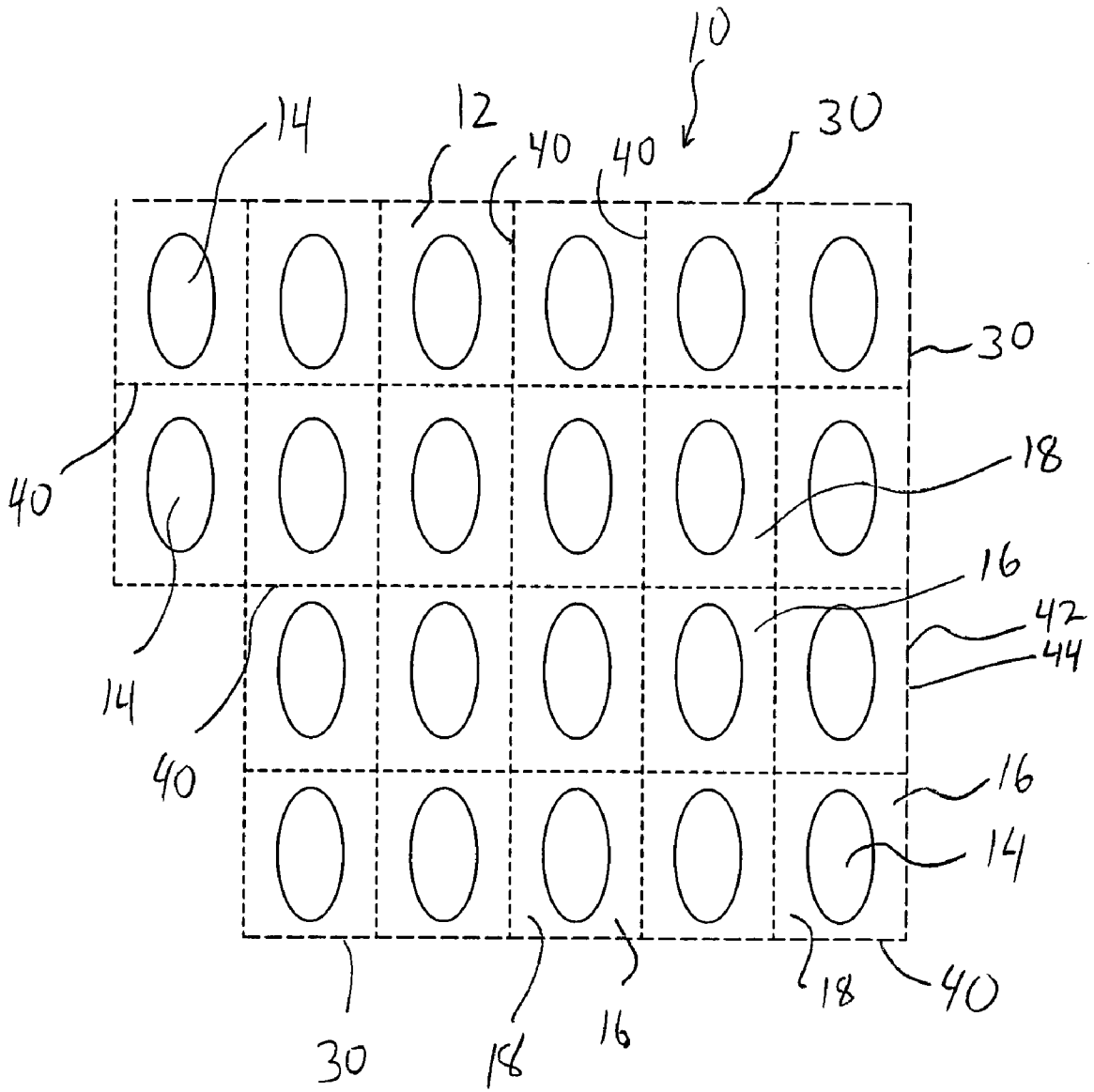
FIG. 3 is a top view of the storage and dispensing unit of FIG. 2, with the empty compartments removed.
Figure 4:
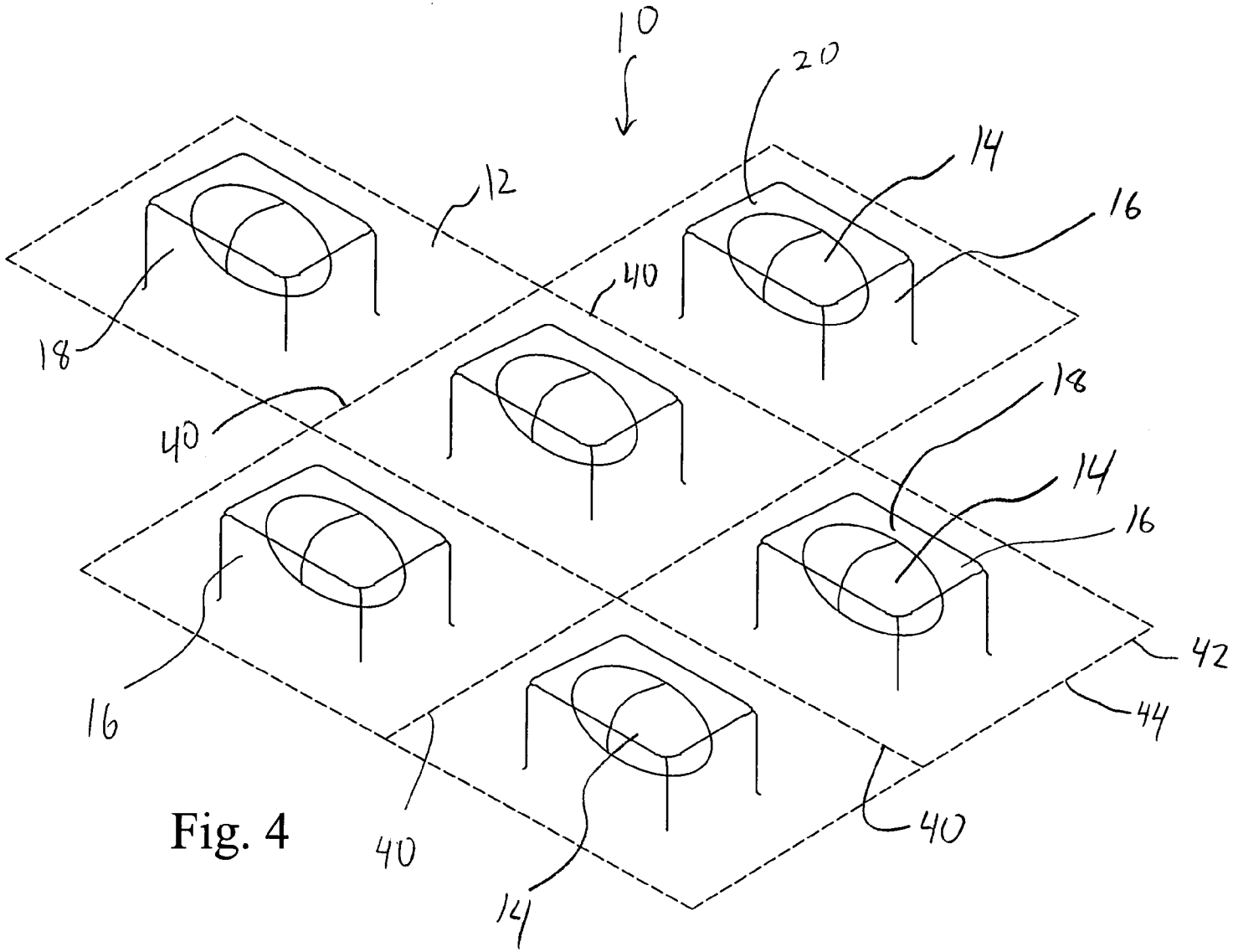
FIG. 4 is a front perspective view of part of the storage and dispensing unit of FIG. 1.

Next, the storage sheet 12 is torn along the interior tear guide lines 40 (i.e., guide lines 40 separating the filled 16 and empty 16' compartments) to separate the filled compartments 16 from the empty compartments 16'. Once the storage sheet 12 has been torn in this manner, the sheet 12 shown in FIG. 3 results. The remaining filled compartments 16 may be redispensed to a different user. The compartments 16 may remain coupled together in their form as shown in FIG. 3 (in which case the partial card 10 may be inserted into a sleeve for subsequent dispensing to a user), or each compartment 16 may be separated along the interior tear guide lines 40 to form a loose collection of compartments 16/medication units 14 which may be stored in a box or the like.

Thus, the perimeter tear guide line 30 allows the storage sheet 12 to be easily torn should the unused medication units 14 be desired to be separated from the empty compartments 16 and dispensed to another user. Furthermore, because the interior tear guide lines 40 are relatively robust, a user can dispense each of the medication units 14 (i.e. by pressing the medication units 14 through the rupture sheet 22) without tearing the interior tear guide lines 40 which would compromise the integrity of the storage sheet 12.

The tear guidelines 30, 40 need not necessarily be interior or perimeter tear guide lines, but may have a wide variety of shapes and configurations. For example, FIG. 6 illustrates another embodiment of the invention, wherein a user may first dispense a first, outer course of medication 80, and then tear the sheet 12' along tear guide line 30'. The user can then dispense the second, intermediate course of medication 82 and then tear the sheet 12' along tear guide line 40'. Of course, the sheet 12 and tear guidelines 30, 40 can be adopted to any of a wide variety of shapes and configurations to suit a wide variety of dispensing practices.

In order to manufacture the medication storage and dispensing unit 10 shown in FIGS. 1-6, the material for the containment sheet 20 is first provided in flat sheet form and the compartments 16 or blisters are formed therein. In particular, the stiffening ridge 34 and compartments 16 are formed by passing the flat containment sheet 20 through an intermittent motion thermoformer which applies heat and air to form the compartments 16 and the reinforcing ridge 34. Each compartment 16 is shaped to generally conform to the shape of the medication unit 14 to be received therein. The compartments 16 of the containment sheet 20 are then filled with the medication units 14 by either a manual, semi-manual or automated process.

Next the rupture sheet 22 is provided, and the rupture sheet may include a thermosetting adhesive or other adhesives or bonding agents located thereon. The rupture sheet 22 is then placed on top of the containment sheet 20, sealing the medication units 14 therebetween, and the resultant assembly is then sealed by the application of heat and pressure. The sealed package is then moved to a perforation station which forms the tear guide lines 30, 40 (i.e. perforation cuts) by blades which penetrate through both the containment sheet and rupture sheet. Of course, if desired, the tear guide lines 30, 40 may be formed at any other step in the process, including before the containment sheet 20 and rupture sheet 22 are joined together. Next, the assembly is moved to a die cut station which cuts the finished package away from the remaining sheet materials thereby defining the outer perimeter 32 of the medication storage and dispensing unit, and the medication storage and dispensing unit is then ready for use.

The invention has been described thus far with respect to medication units 14. However, it should be understood that the storage unit 10 of the present invention is not limited to use with medication units, and may be used with nearly any component which is packaged in a compartment or blister pack. For example, the storage unit 10 may include or be used with candy, chewing gum, seeds, food, trinkets, chemicals, biological specimens, etc.

Having described the invention in detail and by reference to the preferred embodiments, it will be apparent that modifications and variations thereof are possible without departing from the scope of the invention.

What is claimed is:

1. A storage unit comprising:

a storage sheet having a plurality of compartments for storing a component therein, each compartment having a length;

a first tear guide line located on said storage sheet; and a second tear guide line located on said storage sheet, said first and second tear guide lines each having a length greater than a length of each compartment, and wherein said first tear guide line is more easily torn than said second tear guide line.

2. The storage unit of claim 1 wherein said first tear guide line and said second tear guide line are both perforation lines.

3. The storage unit of claim 2 wherein a ratio of cut-to-land of said first tear guide line is greater than a ratio of cut-to-land of said second tear guide line.

4. The storage unit of claim 3 wherein said cut-to-land ratio of said first tear guide line is at least about twice as large as said cut-to-land ratio of said second tear guide line.

5. The storage unit of claim 1 wherein said plurality of components are medication units.

6. The storage unit of claim 1 wherein said first tear guide line is a perimeter tear guide line forming a generally closed shape, and wherein said components are located inside of said generally closed shape.

7. The storage unit of claim 1 wherein said second tear guide line is an interior tear guide line extending between at least two of said components.

8. The storage unit of claim 7 further including a plurality of second tear guide lines located between each adjacent one of said plurality of components such that each component can be separated from the other components of said storage sheet.

9. The storage unit of claim 1 wherein said storage sheet includes an outer perimeter and has an access edge formed therein and at least partially spaced apart from said outer perimeter, and wherein said access edge intersects at least one of said first or second tear guide lines such that said access edge provides access for manually tearing said perimeter tear guide line.

10. A storage unit comprising:

a storage sheet having a plurality of compartments for storing a component therein, said storage sheet having an outer perimeter and an access edge formed therein that is at least partially spaced apart from said outer perimeter; and a tear guide line located on said storage sheet that surrounds said storage sheet and intersects said access edge such that said access edge provides access for tearing said tear guide line, and further wherein tearing said tear guide enables removal of all of said plurality of compartments from said storage unit.

11. The storage unit of claim 10 wherein said access edge is entirely spaced apart from said outer perimeter.

12. The storage unit of claim 10 wherein said access edge defines an opening large enough that a user can insert at least a tip of a finger into said opening to tear said tear guide line.

13. The storage unit of claim 10 wherein said access edge is located generally above said plurality of components and is generally horizontally centered on said storage unit to provide a hanger opening.

14. The storage unit of claim 10 wherein said storage sheet includes an access opening formed therethrough which defines said access edge.

15. The storage unit of claim 10 wherein said tear guide line is a perforation line having a plurality of slits and wherein an access opening provided at the access edge is larger than a slit of said tear guide line.

16. The storage unit of claim 10 wherein said storage sheet lacks any tear guide lines that intersect said outer perimeter.

17. The storage unit of claim 10 wherein said tear guide line is a perimeter tear guide line which forms a generally closed shape and said plurality of components are located inside of said generally closed shape.

18. The storage unit of claim 17 further including an interior tear guide line located on said storage sheet and extending between at least two of said components, and wherein said tear guide line is more easily torn than said interior tear guide line.

19. The storage unit of claim 10 wherein said storage sheet includes a containment sheet and a rupture sheet, and wherein each component is located between said containment sheet and said rupture sheet, and wherein each component can be separated from said storage sheet by manually pressing each component through said rupture sheet.

20. The storage unit of claim 10 wherein said containment sheet includes a plurality of storage compartments, each storage compartment generally closely receiving a medication unit therein.

* * * * *